US009874183B2

(12) United States Patent
Yamaguchi et al.

(10) Patent No.: US 9,874,183 B2
(45) Date of Patent: Jan. 23, 2018

(54) INTAKE MANIFOLD FOR INTERNAL COMBUSTION ENGINE

(71) Applicant: NISSAN MOTOR CO., LTD., Yokohama-shi, Kanagawa (JP)

(72) Inventors: Satoshi Yamaguchi, Zama (JP); Osamu Ooki, Sagamihara (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 134 days.

(21) Appl. No.: 14/408,761

(22) PCT Filed: Apr. 10, 2013

(86) PCT No.: PCT/JP2013/060843

§ 371 (c)(1),
(2) Date: Dec. 17, 2014

(87) PCT Pub. No.: WO2013/190883

PCT Pub. Date: Dec. 27, 2013

(65) Prior Publication Data

US 2015/0114335 A1 Apr. 30, 2015

(30) Foreign Application Priority Data

Jun. 21, 2012 (JP) ..... 2012-139269

(51) Int. Cl.
*F02M 35/112* (2006.01)
*F02M 35/104* (2006.01)
*F02M 35/10* (2006.01)

(52) U.S. Cl.
CPC .... *F02M 35/104* (2013.01); *F02M 35/10321* (2013.01); *F02M 35/10347* (2013.01); *F02M 35/112* (2013.01); *F02M 35/10144* (2013.01); *F05C 2225/08* (2013.01)

(58) Field of Classification Search
CPC ..... F02M 35/0321; F02M 35/112; F02M 35/10144; F02M 35/10347; F05C 2225/08
USPC ..... 123/184.21
See application file for complete search history.

(56) References Cited

U.S. PATENT DOCUMENTS 7,124,727 B2 * 10/2006 Kogawa ..... F02M 35/10052 123/184.21
2007/0044754 A1 * 3/2007 Peffley ..... F02B 31/06 123/306

FOREIGN PATENT DOCUMENTS

JP 61-184858 U 11/1986
JP 3-106163 U 11/1991
JP 2011-220299 A 11/1991

* cited by examiner

*Primary Examiner* — Jacob Amick
*Assistant Examiner* — Charles Brauch
(74) *Attorney, Agent, or Firm* — Foley & Lardner LLP

(57) ABSTRACT

Support bracket and projection which project from curved lower surface of intake manifold are provided. Both parts are arranged in an opposed relation to each other with respect to a center of gravity of the intake manifold when viewed from a longitudinal direction in which a plurality of branches are arranged in parallel to one another. Intake manifold can be stably placed on a flat surface of a floor or the like in such a state that intake manifold is directed downwardly using support bracket and projection as legs. Support bracket also serves as a boss portion for a fixing bolt that fastens an engine body and intake manifold.

4 Claims, 5 Drawing Sheets

INTAKE MANIFOLD FOR INTERNAL COMBUSTION ENGINE

TECHNICAL FIELD

The present invention relates to an intake manifold for an internal combustion engine.

BACKGROUND ART

In the intake manifold of an internal combustion engine, an internal passage is largely curved into a substantially C-shape, for instance, as recited in Patent Literature 1, so as to ensure a predetermined path length with which an inertial supercharging effect can be obtained while reducing a size of the intake manifold. Therefore, a lower surface side of the intake manifold which is located on a lower side in an assembled state of the intake manifold relative to an engine body may be formed into a curved shape.

CITATION LIST

Patent Literature

Patent Literature 1: Japanese Patent Application Unexamined Publication No. 2011-220299 A

SUMMARY OF INVENTION

Technical Problem

In a case where the lower surface side of the intake manifold is formed into a curved shape as described above, when the intake manifold is placed on a floor surface in such a manner that the lower surface side is directed downwardly, a setting ability (stability) of the intake manifold is poor so that the intake manifold may easily tumble down (fall down). Once the intake manifold tumbles down, the intake manifold may cause any damage to components disposed in the vicinity of the lower surface of the intake manifold. Further, upon assembling the intake manifold to the engine body, a worker must perform an additional work to direct the intake manifold toward a mount attitude, so that the working efficiency is deteriorated.

The present invention has been made in consideration of the above circumstances. An object of the present invention is to provide a novel intake manifold that has a curved shape on a lower surface side thereof but can be stably placed on a floor surface or the like in such a state that the lower surface side is directed downwardly.

Solution to Problem

Accordingly, in the present invention, there are provided a support bracket and a projection which downwardly project from a curved lower surface of an intake manifold. The support bracket and the projection are arranged in an opposed relation to each other with respect to a center of gravity of the intake manifold when viewed from a longitudinal direction in which a plurality of intake branches are arranged in parallel to one another. In addition, the support bracket serves as a boss portion for a fixture that fastens an engine body and the intake manifold to each other.

Therefore, when the intake manifold is placed on a flat surface of a floor such that the lower side of the intake manifold is directed downwardly, the support bracket and the projection arranged in the opposed relation to each other with the center of gravity serve as legs so that the intake manifold can be stably self-supported without tumbling down.

Effects of Invention

According to the present invention, notwithstanding that an intake manifold has a curved shape on a lower surface side thereof, the intake manifold can be stably placed on a flat surface of a floor or the like in such a state that the lower surface side of the intake manifold is directed downwardly. Accordingly, it is possible to prevent the intake manifold from tumbling down and suppress interference between the floor surface and the components. In addition, when assembling the intake manifold to the engine body, a worker can be prevented from performing an additional work to direct the intake manifold toward a mount attitude. As a result, the working efficiency can be enhanced. Further, since the support bracket for self-supporting the intake manifold serves as a boss portion far a fixture that fastens the engine body and the intake manifold to each other, a configuration of the intake manifold can be simplified.

DESCRIPTION OF EMBODIMENTS

Figure 1:
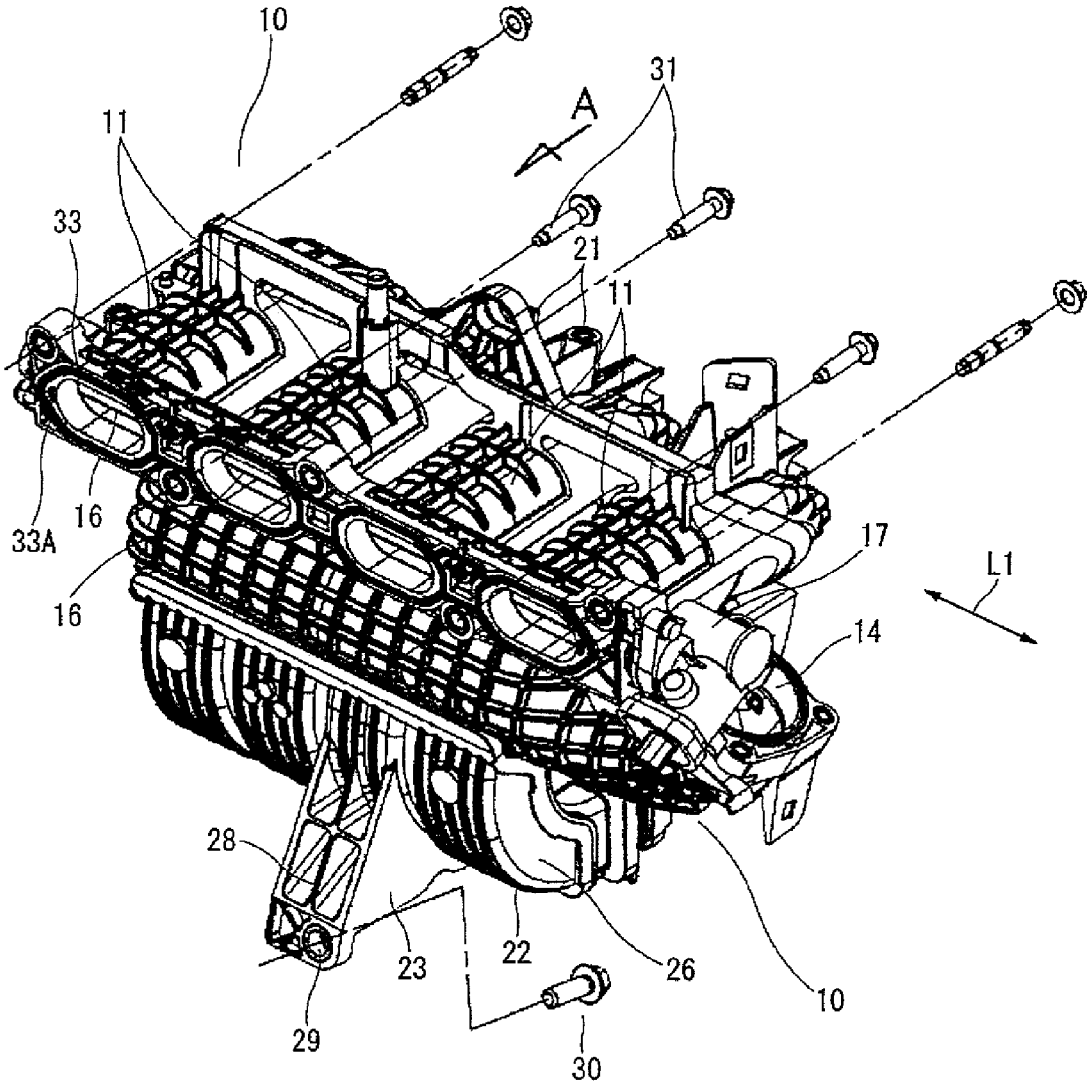
FIG. 1 is a perspective view of an intake manifold according to an embodiment of the present invention.

In the following, intake manifold 10 according to an embodiment of the present invention will be explained by referring to accompanying drawings. Intake manifold 10 is formed by connecting a plurality of parts made by injection molding a synthetic resin material. Intake manifold 10 includes a plurality of intake branches 11 (in this embodiment, four branches) arranged in parallel to one another along a longitudinal direction L1 that is a direction of a row of engine cylinders (see FIG. 1 and FIG. 2). Intake manifold 10 has an internal path largely curved into a generally C shape, and is fixed to an intake-side side wall of cylinder head 12 and cylinder block 13 (see FIG. 3) which constitutes an engine body. As indicated by arrows Y shown in FIG. 4, while turning in a counterclockwise direction in FIG. 4 within the internal path, intake air introduced from intake air introduction port 14 is branched into the plurality of intake branches 11 and supplied to intake ports of respective engine cylinders which are formed in cylinder head 12.

Figure 5:
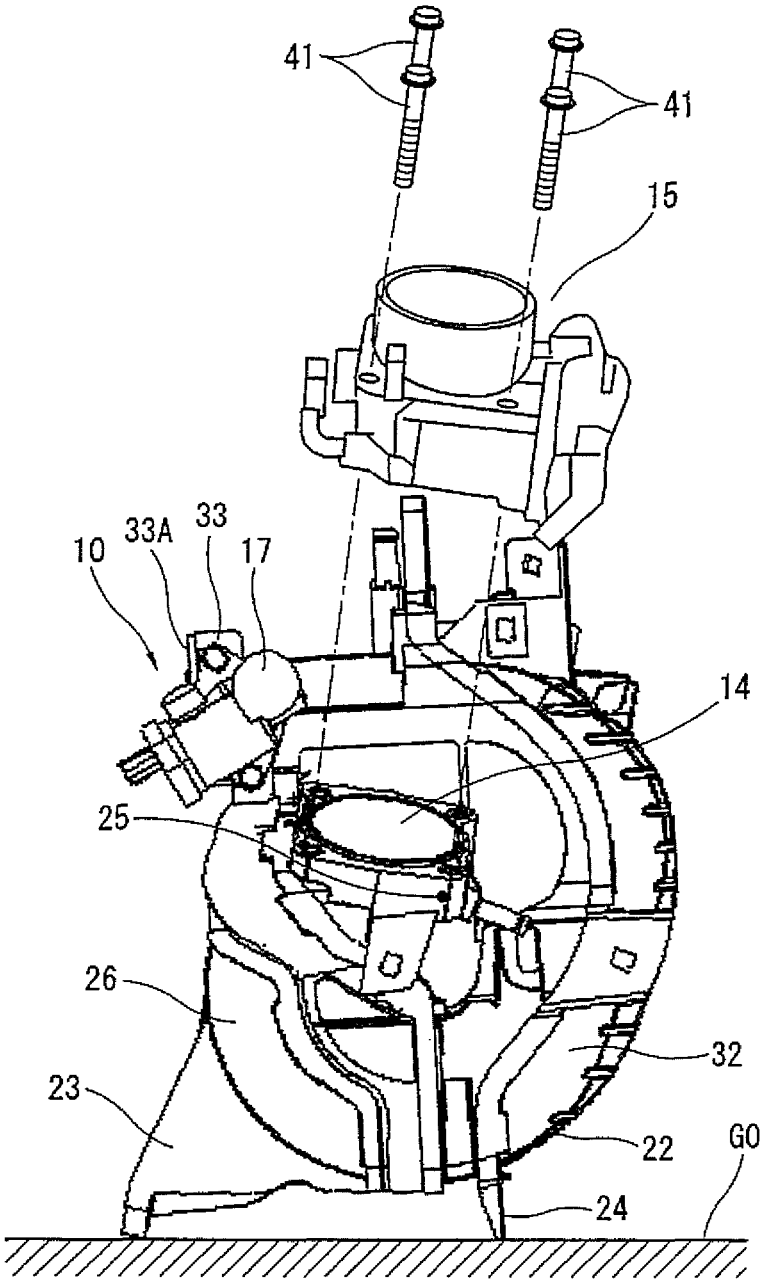
FIG. 5 is a side view of the intake manifold, showing a throttle chamber assembled to the intake manifold.

Mounted to intake air introduction port 14 is throttle chamber 15 having a throttle valve (see FIG. 5). Various peripheral parts are mounted to the vicinity of flange-shaped branch opening portion 33 of intake branches 11. The various peripheral parts include tumble actuator 17 for driving tumble control valve 16 that controls a tumble flow of intake air, position sensor 18 that detects an open/close position of tumble control valve 16, and sensor mount boss portion 19 to which a pressure sensor (not shown) for detecting intake air pressure is mounted. Further, the various peripheral parts include variable intake shutter actuator 20 that drives a variable intake shutter valve (not shown) for performing changeover of effective intake pipe length. Disposed on an outer peripheral portion of intake branches 11 is purge control valve boss portion 21 to which a purge control valve (not shown) is mounted.

Since the internal path of intake manifold 10 is largely curved into the generally C shape as described above, intake manifold 10 has lower surface 22 in a vertical direction in an assembled state in which intake manifold 10 is assembled to cylinder head 12 and cylinder block 13 (that is, the engine body), the lower surface 22 being largely curved into an arcuate shape as a whole. In addition, in this embodiment, there are provided support bracket 23 and projections 24 which project downwardly from curved lower surface 22. Support bracket 23 and projections 24 are arranged in an opposed relation to each other with respect to center of gravity 25 positioned substantially at a center of intake manifold 10 when viewed in longitudinal direction L1 (see FIG. 1 and FIG. 2) as shown in FIG. 4.

Figure 4:
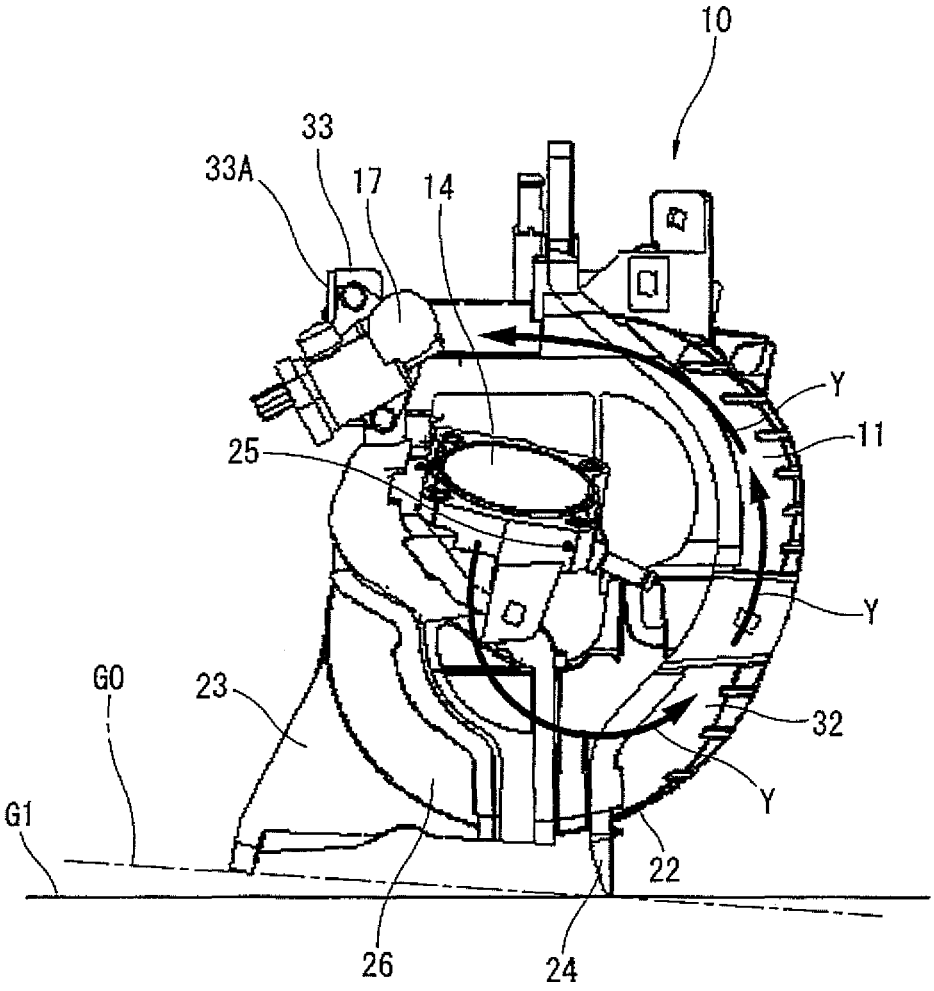
FIG. 4 is a side view of the intake manifold.

Support bracket 23 is formed integrally with half-split part 26 that constitutes an outer peripheral side of a lower left portion of respective intake branches 11 as shown in FIG. 4. Support bracket 23 has an inverted triangular shape tapered downwardly when viewed in the longitudinal direction L1, and extends slantly downward. As shown in FIG. 1, rib 28 for reinforcement is provided within support bracket 23, and bolt hole 29 is formed in a flange portion at a lower end of support bracket 23. Bolt hole 29 extends through the flange portion and serves as a boss portion for fixing bolt 30 into which fixing bolt 30 as a fixture is inserted. Fixing bolt 30 extending through bolt hole 29 is fastened to cylinder block 13 so that support bracket 23 of intake manifold 10 and cylinder block 13 can be fixed to each other. Further, as shown in FIG. 1, an upper side of intake manifold 10 is fixed to cylinder head 12 by means of a plurality of fixing bolts 31 and the like which are provided separately from the above described fixing bolt 30. Specifically, flange-shaped branch opening portion 33 of intake branches 11 is fixed to intake-side side wall 12A to which intake ports of cylinder head 12 are opened, by means of a plurality of fixing bolts 31. Therefore, branch opening surface 33A serving as a mating surface to side wall 12A is formed into a flat surface. Opened to branch opening surface 33A is one end of respective internal paths of the plurality of intake branches 11 which is communicated with the intake ports.

Figure 2:
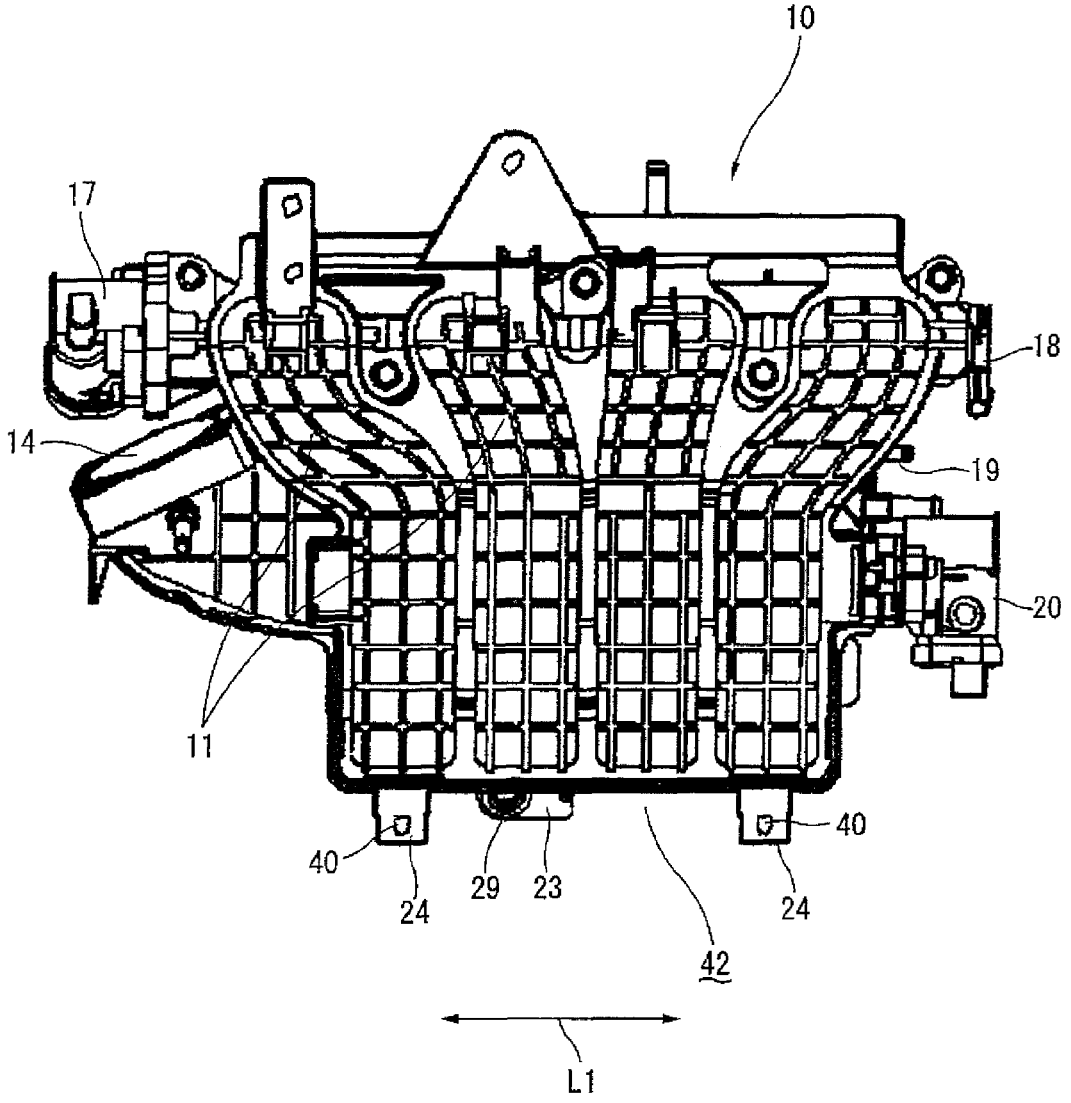
FIG. 2 is a top plan view of the intake manifold.
Figure 3:
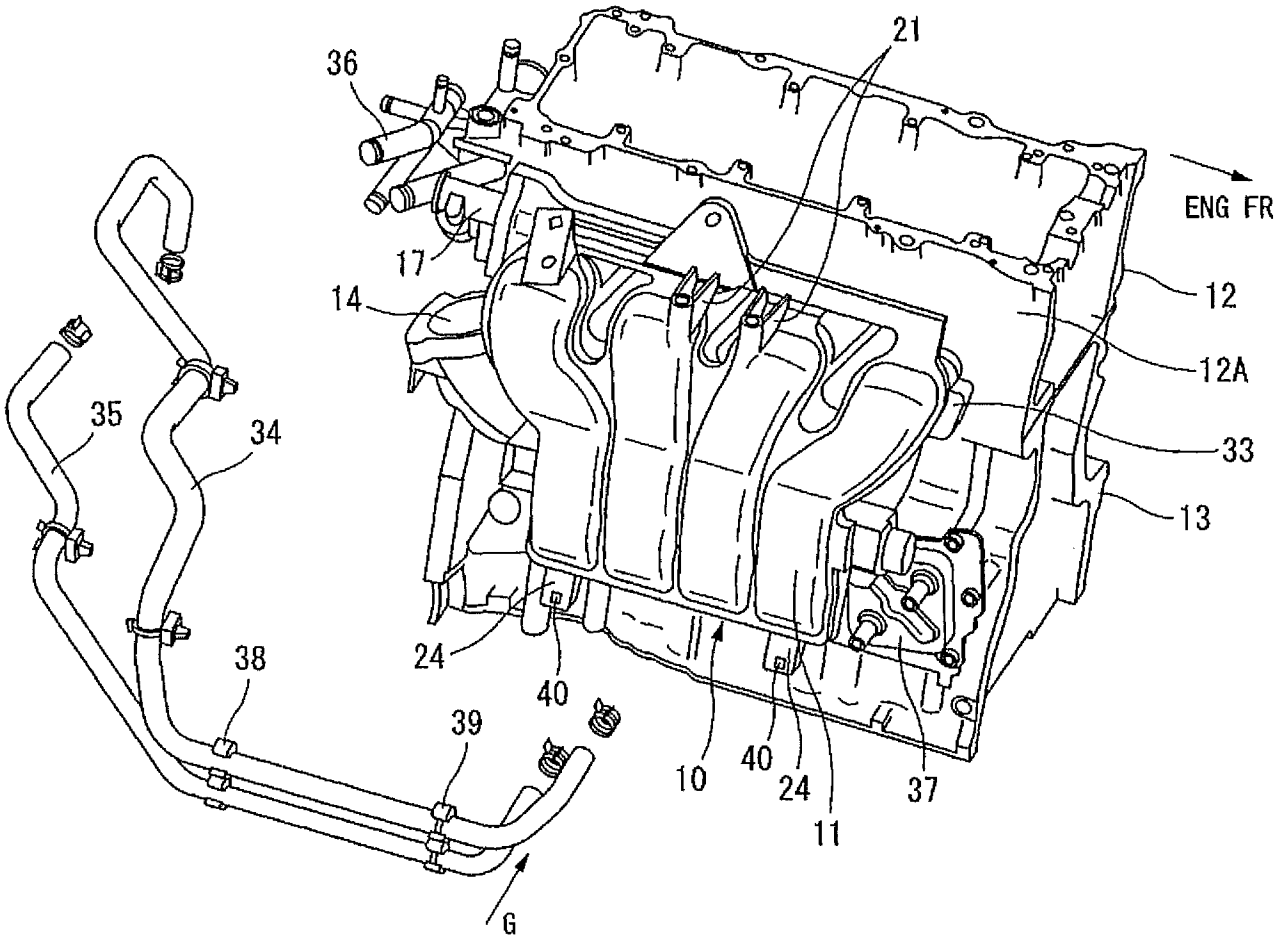
FIG. 3 is a perspective view showing the intake manifold assembled to an engine body.

Projections 24 are formed integrally with half-split part 32 that constitutes an outer peripheral side of a right portion of respective intake branches 11 as shown in FIG. 4. As shown in FIG. 2, projections 24 are disposed in two portions on both sides of intake manifold 10 in the longitudinal direction L1. Each of projections 24 downwardly projects to be of a tongue shape. As shown in FIG. 3, pipes 34, 35 through which cooling water flows are fixed to these projections 24. Specifically, each of projections 24 is formed with mount hole 40 as a fixing portion to which clips 38, 39 for holding two cooling water pipes 34, 35 are fitted and fixed thereto. Cooling water pipes 34, 35 connect water outlet 36 of cylinder head 12 and cooler bracket 37 of cylinder block 13 with each other.

As shown in FIG. 5, when intake manifold 10 is placed on the floor surface GO such that the lower surface side thereof in the assembled state is directed downwardly, support bracket 23 and two projections 24 which are arranged in the opposed relation to each other with respect to the center of gravity 25 serve as legs of three-point support so that intake manifold 10 having curved lower surface 22 can be stably self-supported on the floor surface GO of a platform and the like without tumbling down. Accordingly, it is possible to suppress interference between the components such as tumble actuator 17, etc. and the floor surface GO, and therefore, serve to simplify a packing upon packaging intake manifold 10. Further, for instance, as shown in FIG. 5, even when throttle chamber 15 is assembled to intake manifold 10 using fastening bolts 41, intake manifold 10 can be placed on the floor surface GO or the like in a self-supporting state without using a jig, etc. As a result, working efficiency can be enhanced.

In FIG. 4, reference sign G1 denotes a horizontal plane in the assembled state in which intake manifold 10 is assembled to the engine body, and reference sign G0 denotes a flat surface of a floor in a case where intake manifold 10 is placed on the flat surface of the floor. That is, reference sign G0 denotes a plane connecting a lower end of support bracket 23 and lower ends of projections 24 which are contacted with the floor surface. Thus, an angle θ formed between two planes G0, G1 is set to a small angle of about 0°-20° (degrees). In other words, the plane GO connecting the lower end of support bracket 23 and the lower ends of projections 24 is a plane close to the horizontal plane G1 in the assembled state. Therefore, an attitude of intake manifold 10 when solely placed on the floor surface G0 is substantially same as a mount attitude with respect to the horizontal plane G1 when assembled to the engine body. Accordingly, when assembling intake manifold 10 to the engine body, a worker does not need to perform an additional work to direct intake manifold 10 toward the mount attitude, so that the working efficiency can be enhanced.

Incidentally, it is also considered that intake manifold 10 is placed on a floor surface or the like such that the above-described flat branch opening surface 33A is downwardly directed. In this case, a worker must perform an additional work to direct intake manifold 10 toward the mount attitude, so that the working efficiency is reduced as compared to the construction of intake manifold 10 according to the present embodiment.

Further, as shown in FIG. 1, FIG. 4 and FIG. 5, in a case where intake manifold 10 has a construction in which a part of tumble actuator 17 as a peripheral part extends beyond flat branch opening surface 33A toward an opposite side of intake branches 11 (the left side in FIG. 4 and FIG. 5) so as to cross branch opening surface 33A, the extending part interferes with a floor surface or the like, whereby intake manifold 10 cannot be placed on the floor surface or the like in such a state that flat branch opening surface 33A is directed downwardly. Accordingly, the construction of intake manifold 10 according to the present invention in which intake manifold 10 can be stably placed on a floor surface or the like is particularly effective to such an intake manifold that is provided with a peripheral part so as to cross the flat branch opening surface and cannot be rested on a floor surface or the like in such a state that the branch opening surface is directed downwardly.

Further, support bracket 23 for self-supporting intake manifold 10 also serves as a boss portion for a fixture that fastens the engine body and intake manifold 10 to each other. In addition, projections 24 also serve as fixing portions for holding and fixing cooling water pipes 34, 35. With the provision of support bracket 23 and projections 24, the configuration of intake manifold 10 can be simplified and rationalized.

Furthermore, as shown in FIG. 2, support bracket 23 is arranged in a substantially middle portion of space 42 between two projections 24 when viewed from an assembly direction perpendicular to the longitudinal direction L1. Since a tool for fastening fixing bolt 30 (see FIG. 1) can be inserted through space 42, the fastening work for fixing bolt 30 can be performed without interference between the tool and projections 24.

Although the present invention has been explained above on the basis of the specific embodiment, the present invention is not limited to the above embodiment and may include various modifications and changes. For instance, the number of the support bracket and the projections is not limited to the above embodiment, and the projections may be provided in three or more portions. Further, in the above embodiment, the cooling water pipes are held by the fixing portion, but an oil pipe, an electrical wire, etc. may be held by the fixing portion.

The invention claimed is:

1. An intake manifold for an internal combustion engine, the intake manifold having a curved lower surface located on a lower side in a vertical direction in an assembled state in which the intake manifold is assembled to an engine body, comprising:

a plurality of intake branches arranged in parallel to one another in a longitudinal direction of the intake manifold;

a support bracket outwardly projecting from the curved lower surface of the intake manifold, the support bracket comprising a boss portion for a fixture that fastens the engine body and the intake manifold to each other; and a projection arranged on an opposite side of the support bracket with respect to a center of gravity of the intake manifold as viewed from the longitudinal direction, the projection projecting outwardly from the curved lower surface of the intake manifold, wherein when the intake manifold is placed on a floor surface such that a side of the curved lower surface in the assembled state is downwardly directed, the support bracket and the projection serve as legs to self-support the intake manifold on the floor surface, wherein a plane connecting a lower end of the support bracket and a lower end of the projection is a plane close to a horizontal plane in the assembled state.

2. The intake manifold for an internal combustion engine as claimed in claim 1, wherein the projection comprises a plurality of projections disposed in the longitudinal direction, and the boss portion of the support bracket is arranged in a space between the plurality of projections when viewed in a direction perpendicular to the longitudinal direction.

3. The intake manifold for an internal combustion engine as claimed in claim 1, wherein the projection comprises a fixing portion configured to be fixed to a pipe or a wire.

4. The intake manifold for an internal combustion engine as claimed in claim 1, wherein a peripheral part is provided so as to cross a flat branch opening surface to which one end of respective internal paths of the plurality of intake branches.

* * * * *